US009607539B2

(12) United States Patent
Zuo et al.

(10) Patent No.: US 9,607,539 B2
(45) Date of Patent: Mar. 28, 2017

(54) DISPLAY PANEL CAPABLE OF REDUCING A VOLTAGE LEVEL CHANGING FREQUENCY OF A SELECT SIGNAL AND DRIVE CIRCUIT THEREOF

(71) Applicant: SHENZHEN CHINA STAR OPTOELECTRONICS TECHNOLOGY CO., LTD, Shenzhen (CN)

(72) Inventors: Qingcheng Zuo, Shenzhen (CN); Chang Cao, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/418,081

(22) PCT Filed: Jan. 13, 2015

(86) PCT No.: PCT/CN2015/070620
§ 371 (c)(1),
(2) Date: Jan. 29, 2015

(87) PCT Pub. No.: WO2016/106843
PCT Pub. Date: Jul. 7, 2016

(65) Prior Publication Data

US 2016/0189588 A1 Jun. 30, 2016

(30) Foreign Application Priority Data

Dec. 31, 2014 (CN) ..... 2014 1 0854010

(51) Int. Cl.
*G09G 3/36* (2006.01)
*G09G 3/20* (2006.01)

(52) U.S. Cl.
CPC ..... *G09G 3/2003* (2013.01); *G09G 3/3685* (2013.01); *G09G 2310/0297* (2013.01); *G09G 2310/06* (2013.01); *G09G 2310/08* (2013.01)

(58) Field of Classification Search
CPC ..... G09G 3/3685; G09G 3/2003
(Continued)

(56) References Cited

U.S. PATENT DOCUMENTS 8,587,507 B2 11/2013 Hasegawa
2004/0125065 A1* 7/2004 Park ..... G09G 3/20 345/92

(Continued)

FOREIGN PATENT DOCUMENTS

CN 101038735 A 9/2007
CN 101533616 A 9/2009

(Continued)

*Primary Examiner* — Adam J Snyder
(74) *Attorney, Agent, or Firm* — Mark M. Friedman

(57) ABSTRACT

The present invention discloses a display panel and a drive circuit thereof. The drive circuit comprises: a data signal providing module, generating a data signal; a first select signal generation module, providing a first select signal; a second select signal generation module, providing a second select signal; a select module, comprising a select switch combination receives a first, a second select signal, and outputs the data signal to the pixel array. The present invention can reduce the voltage level changing frequency of the select signal.

18 Claims, 3 Drawing Sheets

(58) Field of Classification Search
USPC ..... 345/204, 100
See application file for complete search history.

(56) References Cited

U.S. PATENT DOCUMENTS

| | | | | |
|---|---|---|---|---|
| 2005/0104817 | A1* | 5/2005 | Kwak | G09G 3/3233 345/76 |
| 2005/0219192 | A1* | 10/2005 | Fujikawa | G09G 3/3688 345/98 |
| 2006/0022909 | A1* | 2/2006 | Kwak | G09G 3/3233 345/76 |
| 2007/0216668 | A1 | 9/2007 | Miyamoto | |
| 2009/0207119 | A1* | 8/2009 | Han | G09G 3/3659 345/98 |
| 2009/0273388 | A1* | 11/2009 | Yamashita | G09G 3/3648 327/416 |
| 2010/0026615 | A1* | 2/2010 | Sasaki | G09G 3/3614 345/92 |
| 2013/0141320 | A1* | 6/2013 | Kim | G09G 3/3685 345/92 |
| 2013/0147780 | A1* | 6/2013 | Kita | G09G 3/3688 345/211 |
| 2015/0213753 | A1* | 7/2015 | Lin | G09G 3/3685 345/214 |

FOREIGN PATENT DOCUMENTS

| | | | |
|---|---|---|---|
| CN | 101887676 | A | 11/2010 |
| CN | 104575355 | A | 4/2015 |

* cited by examiner

DISPLAY PANEL CAPABLE OF REDUCING A VOLTAGE LEVEL CHANGING FREQUENCY OF A SELECT SIGNAL AND DRIVE CIRCUIT THEREOF

FIELD OF THE INVENTION

The present invention relates to a display technology field, and more particularly to a display panel and a drive circuit thereof.

BACKGROUND OF THE INVENTION

A traditional display panel generally comprises a drive circuit, and the traditional drive circuit is employed to control the pixel units in the display panel to show corresponding images.

The technical solution of the traditional drive circuit for driving the display panel generally is:

The drive circuit generates a scan signal, a data signal and a select signal, and the scan signal is sent to the pixel unit via the scan line, and the data signal is sent to the pixel unit via the data line, and the select signal is employed to selectably control the output of the data signal to the pixel unit.

In practical, the inventors found at least following problems existing in prior art:

During the procedure of scanning the pixel unit of the display panel with the scan signal, the select signal requires voltage level changing when the scan object is switched from one pixel line to another pixel line. Therefore, the voltage level changing frequency of the select signal is higher.

Consequently, there is a need to provide a new technical solution for solving the aforesaid technical problem.

SUMMARY OF THE INVENTION

An objective of the present invention is to provide a display panel and a drive circuit thereof, which can reduce the voltage level changing frequency of the select signal of the drive circuit.

For solving the aforesaid issue, the technical solution of the present invention is:

A drive circuit, wherein the drive circuit is employed to control a pixel array in a corresponding display panel to show images, and the drive circuit comprises: a data signal providing module, generating a data signal, and the data signal is provided to the pixel array; a first select signal generation module, providing a first select signal; a second select signal generation module, providing a second select signal; and a select module, and the select module comprises: at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal; the select switch combination comprises: a first switch, and the first switch is electrically coupled to the first select signal generation module, the data signal providing module and a first pixel column in the pixel array; a second switch, and the second switch is electrically coupled to the second select signal generation module, the data signal providing module and a second pixel column in the pixel array; a third switch, and the third switch is electrically coupled to the first select signal generation module and the data signal providing module; and a fourth switch, and the fourth switch is electrically coupled to the second select signal generation module, the third switch and a third pixel column in the pixel array; the drive circuit further comprises a scan signal providing module, and the scan signal providing module is electrically coupled to the pixel array, and the scan signal providing module generates a scan signal, and sends the same to the pixel array.

In the aforesaid drive circuit, the first switch comprises: a first control end, and the first control end is electrically coupled to the first select signal generation module; a first input end, and the first input end is electrically coupled to the data signal providing module; and a first output end, and the first output end is electrically coupled to the first pixel column; wherein the first control end receives the first select signal, and controls on and off of a first current channel between the first input end and the first output end according to the first select signal; the second switch comprises: a second control end, and the second control end is electrically coupled to the second select signal generation module; a second input end, and the second input end is electrically coupled to the data signal providing module; and a second output end, and the second output end is electrically coupled to the first pixel column; wherein the second control end receives the second select signal, and controls on and off of a second current channel between the second input end and the second output end according to the second select signal; the third switch comprises: a third control end, and the third control end is electrically coupled to the first select signal generation module; a third input end, and the third input end is electrically coupled to the data signal providing module; and a third output end, and the third output end is electrically coupled to the fourth switch; wherein the third control end receives the third select signal, and controls on and off of a third current channel between the third input end and the third output end according to the first select signal; the fourth switch comprises: a fourth control end, and the fourth control end is electrically coupled to the second select signal generation module; a fourth output end, and the fourth output end is electrically coupled to the third output end; a fourth output end, and the fourth output end is electrically coupled to the third pixel column; wherein the fourth control end receives the fourth select signal, and controls on and off of a fourth current channel between the fourth input end and the fourth output end according to the second select signal.

In the aforesaid drive circuit, the first current channel is off when the third current channel is on, and on when the third current channel is off; the second current channel is off when the fourth current channel is on, and on when the fourth current channel is off; the third current channel is off when the first current channel is on, and on when the first current channel is off; the fourth current channel is off when the second current channel is on, and on when the second current channel is off.

In the aforesaid drive circuit, a high voltage level duration of the first select signal and a high voltage level duration of the second select signal are the same, and a low voltage level duration of the first select signal and a low voltage level duration of the second select signal are the same; both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer; a starting point of a rising edge of a high voltage level of a scan signal of the pixel array is in the high voltage level duration of the first select signal or the high voltage level duration of the second select signal.

A drive circuit, wherein the drive circuit is employed to control pixel array in a corresponding display panel to show images, and the drive circuit comprises: a data signal providing module, generating a data signal, and the data signal is provided to the pixel array; a first select signal generation module, providing a first select signal; a second select signal generation module, providing a second select signal; and a select module, and the select module comprises: at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal.

In the aforesaid drive circuit, the switch combination comprises: a first switch, and the first switch is electrically coupled to the first select signal generation module, the data signal providing module and a first pixel column in the pixel array; a second switch, and the second switch is electrically coupled to the second select signal generation module, the data signal providing module and a second pixel column in the pixel array; a third switch, and the third switch is electrically coupled to the first select signal generation module and the data signal providing module; and a fourth switch, and the fourth switch is electrically coupled to the second select signal generation module, the third switch and a third pixel column in the pixel array.

In the aforesaid drive circuit, the first switch comprises: a first control end, and the first control end is electrically coupled to the first select signal generation module; a first input end, and the first input end is electrically coupled to the data signal providing module; and a first output end, and the first output end is electrically coupled to the first pixel column; wherein the first control end receives the first select signal, and controls on and off of a first current channel between the first input end and the first output end according to the first select signal; the second switch comprises: a second control end, and the second control end is electrically coupled to the second select signal generation module; a second input end, and the second input end is electrically coupled to the data signal providing module; and a second output end, and the second output end is electrically coupled to the first pixel column; wherein the second control end receives the second select signal, and controls on and off of a second current channel between the second input end and the second output end according to the second select signal; the third switch comprises: a third control end, and the third control end is electrically coupled to the first select signal generation module; a third input end, and the third input end is electrically coupled to the data signal providing module; and a third output end, and the third output end is electrically coupled to the fourth switch; wherein the third control end receives the third select signal, and controls on and off of a third current channel between the third input end and the third output end according to the first select signal; the fourth switch comprises: a fourth control end, and the fourth control end is electrically coupled to the second select signal generation module; a fourth output end, and the fourth output end is electrically coupled to the third output end; a fourth output end, and the fourth output end is electrically coupled to the third pixel column; wherein the fourth control end receives the fourth select signal, and controls on and off of a fourth current channel between the fourth input end and the fourth output end according to the second select signal.

In the aforesaid drive circuit, the first control end is electrically coupled to the first select signal generation module via a first signal line; the second control end, and the second control end is electrically coupled to the second select signal generation module via a second signal line; the third control end is electrically coupled to the first select signal generation module via the first signal line; the fourth control end is electrically coupled to the second select signal generation module via the second signal line.

In the aforesaid drive circuit, the first current channel is off when the third current channel is on, and on when the third current channel is off; the second current channel is off when the fourth current channel is on, and on when the fourth current channel is off; the third current channel is off when the first current channel is on, and on when the first current channel is off; the fourth current channel is off when the second current channel is on, and on when the second current channel is off.

In the aforesaid drive circuit, both the first switch and the second switch are NMOS TFTs, and both the third switch and the fourth switch are PMOS TFTs; or both the first switch and the second switch are PMOS TFTs, and both the third switch and the fourth switch are NMOS TFTs.

In the aforesaid drive circuit, a high voltage level duration of the first select signal and a high voltage level duration of the second select signal are the same, and a low voltage level duration of the first select signal and a low voltage level duration of the second select signal are the same; both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer; a starting point of a rising edge of a high voltage level of a scan signal of the pixel array is in the high voltage level duration of the first select signal or the high voltage level duration of the second select signal.

In the aforesaid drive circuit, a high voltage level duration of the scan signal is 3K clock unit cycles, and a low voltage level duration of the scan signal is 3K clock unit cycles, too.

A display panel, and the display panel comprises: a pixel array; and a drive circuit, wherein the drive circuit is employed to control the pixel array in a corresponding display panel to show images, and the drive circuit comprises: a data signal providing module, generating a data signal, and the data signal is provided to the pixel array; a first select signal generation module, providing a first select signal; a second select signal generation module, providing a second select signal; and a select module, and the select module comprises: at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal.

In the aforesaid display panel,

In the aforesaid display panel, the first switch comprises: a first control end, and the first control end is electrically coupled to the first select signal generation module; a first input end, and the first input end is electrically coupled to the data signal providing module; and a first output end, and the first output end is electrically coupled to the first pixel column; wherein the first control end receives the first select signal, and controls on and off of a first current channel between the first input end and the first output end according to the first select signal; the second switch comprises: a second control end, and the second control end is electrically coupled to the second select signal generation module; a second input end, and the second input end is electrically coupled to the data signal providing module; and a second output end, and the second output end is electrically coupled to the first pixel column; wherein the second control end receives the second select signal, and controls on and off of a second current channel between the second input end and the second output end according to the second select signal; the third switch comprises: a third control end, and the third control end is electrically coupled to the first select signal generation module; a third input end, and the third input end is electrically coupled to the data signal providing module; and a third output end, and the third output end is electrically coupled to the fourth switch; wherein the third control end receives the third select signal, and controls on and off of a third current channel between the third input end and the third output end according to the first select signal; the fourth switch comprises: a fourth control end, and the fourth control end is electrically coupled to the second select signal generation module; a fourth output end, and the fourth output end is electrically coupled to the third output end; a fourth output end, and the fourth output end is electrically coupled to the third pixel column; wherein the fourth control end receives the fourth select signal, and controls on and off of a fourth current channel between the fourth input end and the fourth output end according to the second select signal.

In the aforesaid display panel, the first control end is electrically coupled to the first select signal generation module via a first signal line; the second control end, and the second control end is electrically coupled to the second select signal generation module via a second signal line; the third control end is electrically coupled to the first select signal generation module via the first signal line; the fourth control end is electrically coupled to the second select signal generation module via the second signal line.

In the aforesaid display panel, the first current channel is off when the third current channel is on, and on when the third current channel is off; the second current channel is off when the fourth current channel is on, and on when the fourth current channel is off; the third current channel is off when the first current channel is on, and on when the first current channel is off; the fourth current channel is off when the second current channel is on, and on when the second current channel is off.

In the aforesaid display panel, both the first switch and the second switch are NMOS TFTs, and both the third switch and the fourth switch are PMOS TFTs; or both the first switch and the second switch are PMOS TFTs, and both the third switch and the fourth switch are NMOS TFTs.

In the aforesaid display panel, a high voltage level duration of the first select signal and a high voltage level duration of the second select signal are the same, and a low voltage level duration of the first select signal and a low voltage level duration of the second select signal are the same; both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer; a starting point of a rising edge of a high voltage level of a scan signal of the pixel array is in the high voltage level duration of the first select signal or the high voltage level duration of the second select signal.

In the aforesaid drive circuit, a high voltage level duration of the scan signal is 3K clock unit cycles, and a low voltage level duration of the scan signal is 3K clock unit cycles, too.

Compared with prior art, the present invention can effectively reduce the voltage level changing frequency of the select signal of the drive circuit.

For a better understanding of the aforementioned content of the present invention, preferable embodiments are illustrated in accordance with the attached figures for further explanation.

DETAILED DESCRIPTION OF PREFERRED EMBODIMENTS

The word, "an embodiment" used in this specification means serving as an example, an instance, or an illustration. Besides, in this specification and the appended claims, the articles "a" generally means "one or more" unless specified otherwise or the singular form can be clearly confirmed in the context.

Figure 1:
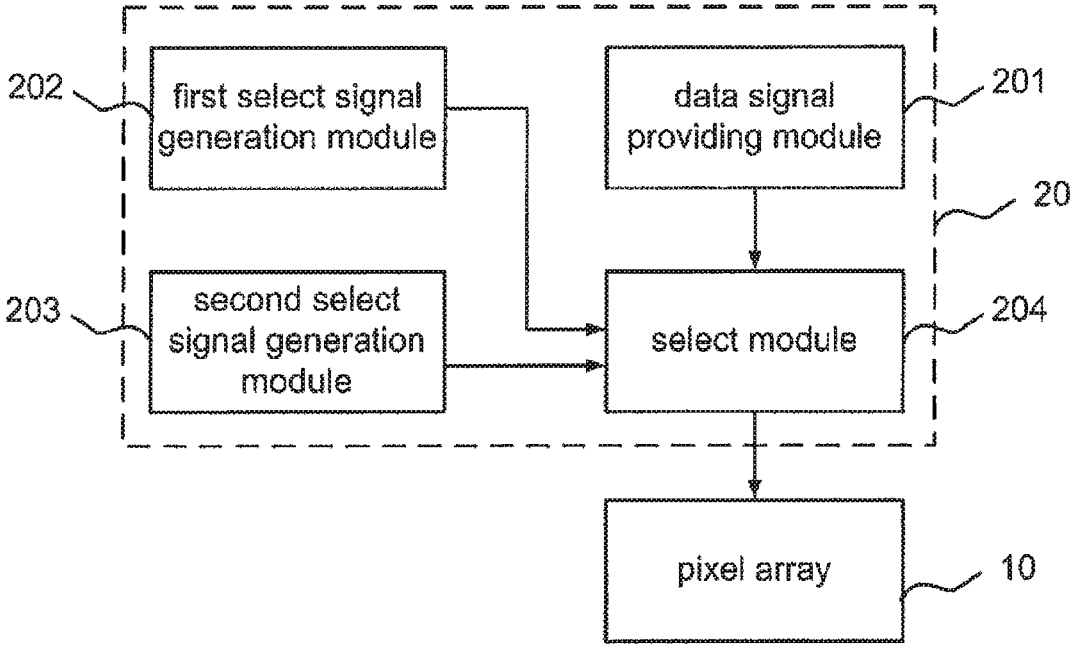
FIG. 1 is a frame diagram of a display panel according to the present invention.

Please referring to FIG. 1 and FIG. 1 is a frame diagram of a display panel according to the present invention.

The display panel of the present invention can be a TFT-LCD (Thin Film Transistor Liquid Crystal Display panel) or an OLED (Organic Light Emitting Diodes Display panel).

The display panel of the present invention comprises a pixel array 10 and a drive circuit 20.

The drive circuit 20 is electrically coupled to the pixel array 10 in the display panel, and the drive circuit 20 is employed to control the pixel array 10 to show images, and the drive circuit 20 comprises a data signal providing module 201, a first select signal generation module 202, a second select signal generation module 203 and a select module 204.

The data signal providing module 201 generates a data signal, and the data signal is provided to the pixel array 10. The first select signal generation module 202 provides a first select signal MUX1. The second select signal generation module 203 provides a second select signal MUX2. The select module 204 comprises at least two select switch combinations, and the select switch combination is electrically coupled to the first select signal generation module 202, the second select signal generation module 203, the data signal providing module 201 and the pixel array 10, and the select switch combination receives the first select signal MUX1, the second select signal MUX2 and the data signal, and outputs the data signal to the pixel array 10 according to the first select signal MUX1 and the second select signal MUX2.

The drive circuit 20 further comprises a scan signal providing module, and the scan signal providing module is electrically coupled to the pixel array 10, and the scan signal providing module generates a scan signal (gate signal), and sends the same to the pixel array 10.

Figure 2:
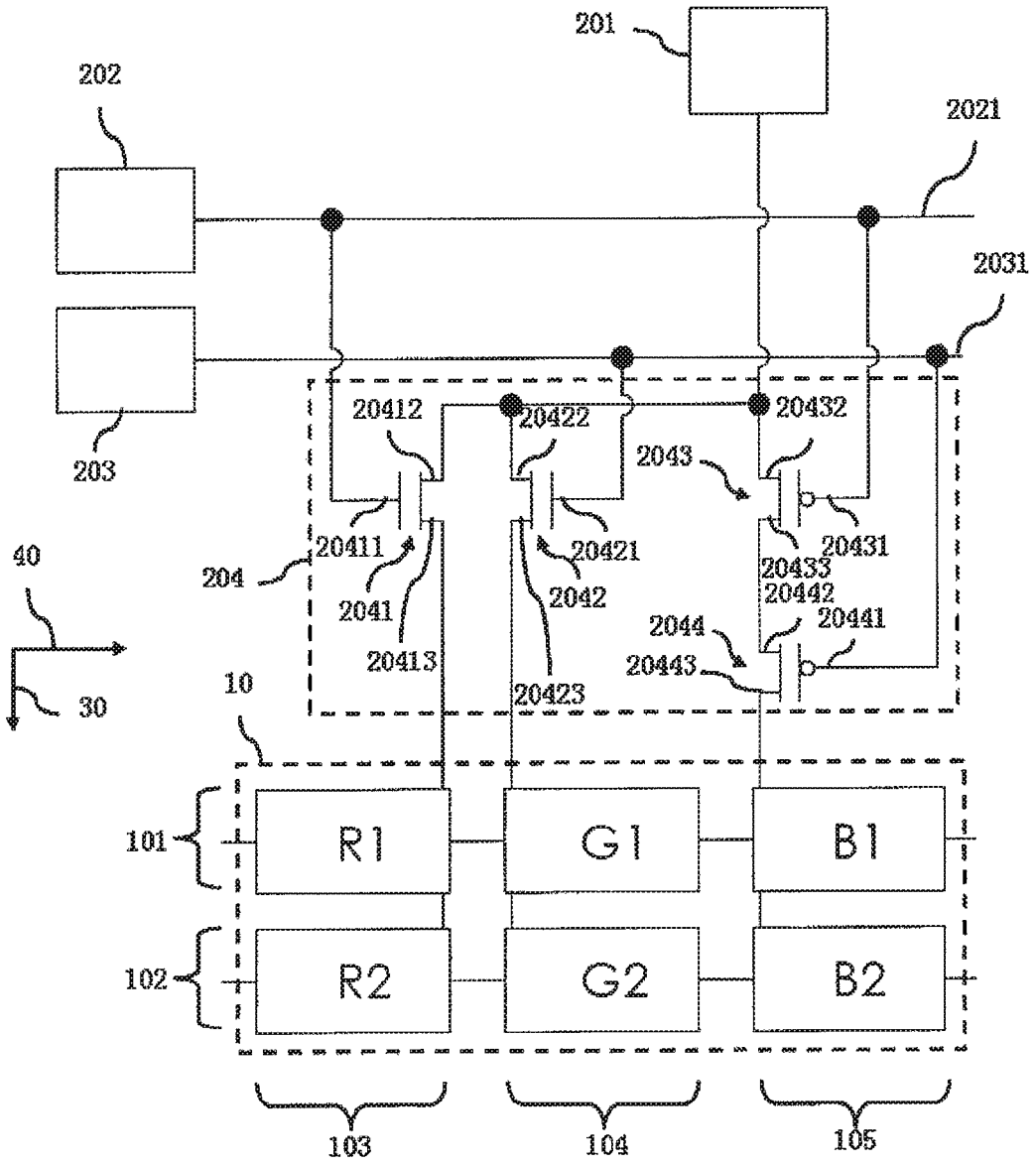
FIG. 2 is a circuit diagram of the first embodiment of the display panel shown in FIG. 1.

Refer to FIG. 2, and FIG. 2 is a circuit diagram of the first embodiment of the display panel shown in FIG. 1.

In this embodiment, the pixel array 10 comprises at least one first pixel column 101 and at least one second pixel column 102, and the first pixel column 101 and the second pixel column 102 are aligned in array (one dimension) form along a first direction 30. The first pixel column 101 comprises at least one first pixel R1, at least one second pixel G1 and at least one third pixel B1, and the first pixel R1, the second pixel G1 and the third pixel B1 are aligned in array (one dimension) form along a second direction 40. The second pixel column 102 comprises at least one fourth pixel R2, at least one fifth pixel G2 and at least one sixth pixel B2, and the fourth pixel R2, the fifth pixel G2 and the sixth pixel B2 are aligned in array (one dimension) form along a second direction 40. The pixel array 10 comprises at least one first pixel column 103, at least one second pixel column 104 and at least one third pixel column 105, wherein the first pixel column 103 comprises the first pixel R1 and the fourth pixel R2, and second pixel column 104 comprises the second pixel G1 and the fifth pixel G2, and the third pixel column 105 comprises the third pixel B1 and the sixth pixel B2. The first direction 30 and the second direction 40 are perpendicular.

In this embodiment, the select switch combination comprises a first switch 2041, a second switch 2042, a third switch 2043 and a fourth switch 2044. The first switch 2041 is electrically coupled to the first select signal generation module 202, the data signal providing module 201 and the first pixel column 103 in the pixel array 10. The second switch 2042 is electrically coupled to the second select signal generation module 203, the data signal providing module 201 and the second pixel column 104 in the pixel array 10. The third switch 2043 is electrically coupled to the first select signal generation module 202, the data signal providing module 201 and the fourth switch 2044. The fourth switch 2044 is electrically coupled to the second select signal generation module 203, the third switch 2043 and the third pixel column 105 in the pixel array 10.

In this embodiment, all the first switch 2041, the second switch 2042, the third switch 2043 and the fourth switch 2044 can be triodes. The first switch 2041 comprises a first control end 24011, a first input end 20412 and a first output end 20413. The first control end 24011 is electrically coupled to the first select signal generation module 202, and specifically, the first control end 24011 is electrically coupled to the first select signal generation module 202 via a first signal line 2021. The first input end 20412 is electrically coupled to the data signal providing module 201. The first output end 20413 is electrically coupled to the first pixel column 103. The first control end 24011 receives the first select signal MUX1, and controls on and off of a first current channel between the first input end 20412 and the first output end 20413 according to the first select signal MUX1.

The second switch 2042 comprises a second control end 24021, a second input end 20422 and a second output end 20423. The second control end 24021 is electrically coupled to the second select signal generation module 203, and specifically, second control end 24021 is electrically coupled to the second select signal generation module 203 via a second signal line 2031. The second input end 20422 is electrically coupled to the data signal providing module 201. The second output end 20423 is electrically coupled to the second pixel column 104. The second control end 24021 receives the second select signal MUX2, and controls on and off of a second current channel between the second input end 20422 and the second output end 20423 according to the second select signal MUX2.

The third switch 2043 comprises a third control end 24031, a third input end 20432 and a third output end 20433. The third control end 24031 is electrically coupled to the first select signal generation module 202, and specifically, the third control end 24031 is electrically coupled to the first select signal generation module 202 via a first signal line 2021. The third input end 20432 is electrically coupled to the data signal providing module 201. The third output end 20433 is electrically coupled to the fourth switch 2044. The third control end 24031 receives the first select signal MUX1, and controls on and off of a third current channel between the third input end 20432 and the third output end 20433 according to the first select signal MUX1.

The fourth switch 2044 comprises a fourth control end 24041, a fourth input end 20442 and a fourth output end 20443. The fourth control end 24041 is electrically coupled to the second select signal generation module 203, and specifically, fourth control end 24041 is electrically coupled to the second select signal generation module 203 via a second signal line 2031. The fourth input end 20442 is electrically coupled to the third output end 20433. The fourth output end 20443 is electrically coupled to the third pixel column 105. The fourth control end 24041 receives the second select signal MUX2, and controls on and off of a fourth current channel between the fourth input end 20442 and the fourth output end 20443 according to the second select signal MUX2.

In this embodiment, both the first switch 2041 and the second switch 2042 are NMOS (Negative channel Metal Oxide Semiconductor) TFTs, and both the third switch 2043 and the fourth switch 2044 are PMOS (Positive channel Metal Oxide Semiconductor) TFTs.

The first current channel is off when the third current channel is on, and on when the third current channel is off.

The second current channel is off when the fourth current channel is on, and on when the fourth current channel is off.

The third current channel is off when the first current channel is on, and on when the first current channel is off.

The fourth current channel is off when the second current channel is on, and on when the second current channel is off.

In this embodiment, a high voltage level duration of the first select signal MUX1 and a high voltage level duration of the second select signal MUX2 are the same, and a low voltage level duration of the first select signal MUX1 and a low voltage level duration of the second select signal MUX2 are the same.

Both a high voltage level duration of the first select signal MUX1 and a high voltage level duration of the second select signal MUX2 are 2K clock unit cycles, and both a low voltage level duration of the first select signal MUX1 and a low voltage level duration of the second select signal MUX2 are 4K clock unit cycles, and a high voltage level duration of the scan signal (comprising a first scan signal Gate1 corresponded with the first pixel column 101, a second scan signal Gate2 corresponded with the second pixel column 102) is 3K clock unit cycles, and a low voltage level duration of the scan signal is 3K clock unit cycles, too. The K is a positive integer. For instance, K=1.

A starting point of a rising edge of a high voltage level of a scan signal of the pixel array 10 is in the high voltage level duration of the first select signal MUX1 or the high voltage level duration of the second select signal MUX2.

Figure 3:
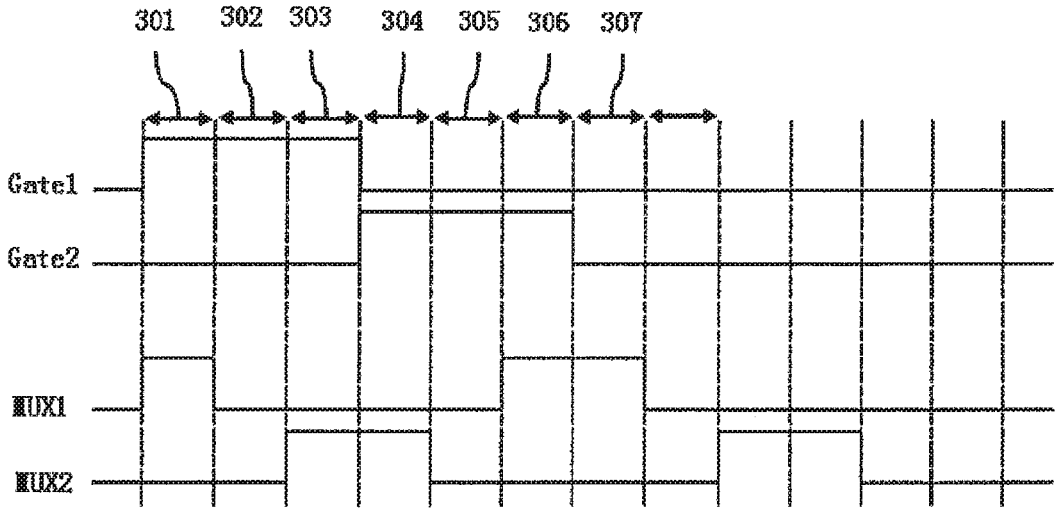
FIG. 3 is a waveform diagram showing drive signals of the display panel shown in FIG. 2.

Refer to FIG. 3, and FIG. 3 is a waveform diagram showing drive signals of the display panel shown in FIG. 2.

That the first scan signal Gate1 corresponded with the first pixel column 101 and the second scan signal Gate2 corresponded with the second pixel column 102 activate the switches of the pixels in the pixel array 10 at high voltage level and deactivate the switches of the pixels in the pixel array 10 at low voltage level is illustrated for explanation below and vice versa.

In the first clock unit cycle 301:

When the first scan signal Gate1 generated by the scan signal providing module is high voltage level, the second scan signal Gate2 is low voltage level. At this moment, the switches of the first pixel R1, the second pixel G1 and the third pixel B1 are on, and the switches of the fourth pixel R2, the fifth pixel G2 and the sixth pixel B2 are off.

The first select signal MUX1 is high voltage level, and the second select signal MUX2 is low voltage level. At the moment, the first current channel of the first switch 2041 is on, and the second current channel of the second switch 2042 is off, and the third current channel of the third switch 2043 is off, and the fourth current channel of the fourth switch 2044 is on. The data signal is inputted to the first pixel R1 of the first pixel column 103 via the first current channel to charge the first pixel R1.

In the first clock unit cycle 302:

The first scan signal Gate1 is remaining to be high voltage level, the second scan signal Gate2 is remaining to be low voltage level. At this moment, the switches of the first pixel R1, the second pixel G1 and the third pixel B1 are on, and the switches of the fourth pixel R2, the fifth pixel G2 and the sixth pixel B2 are off.

The first select signal MUX1 is low voltage level, and the second select signal MUX2 is low voltage level. At the moment, the first current channel is off, and the second current channel is off, and the third current channel is on, and the fourth current channel is on. The data signal is inputted to the third pixel B1 of the third pixel column 105 via the third current channel and the fourth current channel to charge the third pixel B1.

In the first clock unit cycle 303:

The first scan signal Gate1 is remaining to be high voltage level, the second scan signal Gate2 is remaining to be low voltage level. At this moment, the switches of the first pixel R1, the second pixel G1 and the third pixel B1 are on, and the switches of the fourth pixel R2, the fifth pixel G2 and the sixth pixel B2 are off.

The first select signal MUX1 is low voltage level, and the second select signal MUX2 is high voltage level. At the moment, the first current channel is off, and the second current channel is on, and the third current channel is on, and the fourth current channel is off. The data signal is inputted to the second pixel G1 of the second pixel column 104 via the second current channel to charge the second pixel G1.

In the first clock unit cycle 304:

The first scan signal Gate1 is low voltage level, the second scan signal Gate2 is high voltage level. At this moment, the switches of the first pixel R1, the second pixel G1 and the third pixel B1 are off, and the switches of the fourth pixel R2, the fifth pixel G2 and the sixth pixel B2 are on.

The first select signal MUX1 is kept to be low voltage level, and the second select signal MUX2 is kept to be high voltage level. At the moment, the first current channel is off, and the second current channel is on, and the third current channel is on, and the fourth current channel is off. The data signal is inputted to the fifth pixel G2 of the second pixel column 104 via the second current channel to charge the fifth pixel G2.

In the first clock unit cycle 305:

The first scan signal Gate1 is remaining to be low voltage level, the second scan signal Gate2 is remaining to be high voltage level. At this moment, the switches of the first pixel R1, the second pixel G1 and the third pixel B1 are off, and the switches of the fourth pixel R2, the fifth pixel G2 and the sixth pixel B2 are on.

The first select signal MUX1 is kept to be low voltage level, and the second select signal MUX2 is low voltage level. At the moment, the first current channel is off, and the second current channel is off, and the third current channel is on, and the fourth current channel is on. The data signal is inputted to the sixth pixel B2 of the third pixel column 105 via the third current channel and the fourth current channel to charge the sixth pixel B2.

In the first clock unit cycle 306:

The first scan signal Gate1 is remaining to be low voltage level, the second scan signal Gate2 is remaining to be high voltage level. At this moment, the switches of the first pixel R1, the second pixel G1 and the third pixel B1 are off, and the switches of the fourth pixel R2, the fifth pixel G2 and the sixth pixel B2 are on.

The first select signal MUX1 is high voltage level, and the second select signal MUX2 is remaining to be low voltage level. At the moment, the first current channel is on, and the second current channel is off, and the third current channel is off, and the fourth current channel is on. The data signal is inputted to the fourth pixel R2 of the first pixel column 103 via the first current channel to charge the fourth pixel R2.

And the procedure is so on until the refresh of the entire image is accomplished.

With the aforesaid technical solutions, the voltage level changing frequency of the select signal can be effectively reduced, i.e. the voltage level changing frequency of the select signal is diminished from N times/frame to N/2 times/frame, wherein the N is the amount of the pixel rows of the pixel array.

Besides, the aforesaid technical solution is beneficial to reducing the amount of the wirings of the display panel, and accordingly, promotion for the resolution of the display panel is not restricted by the amount of the wirings.

The second embodiment of the display panel according to the present invention is similar with the first embodiment, and the difference is:

Both the first switch 2041 and the second switch 2042 are PMOS (Positive channel Metal Oxide Semiconductor) TFTs, and both the third switch 2043 and the fourth switch 2044 are NMOS (Negative channel Metal Oxide Semiconductor) TFTs.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive circuit capable of reducing a voltage level changing frequency of a select signal, wherein the drive circuit is employed to control a pixel array in a corresponding display panel to show images, and the drive circuit comprises:

a data signal providing module, generating a data signal, and the data signal is provided to the pixel array;

a first select signal generation module, providing a first select signal;

a second select signal generation module, providing a second select signal; and a select module, and the select module comprises:

at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal;

the select switch combination comprises:

a first switch, and the first switch is electrically coupled to the first select signal generation module, the data signal providing module and a first pixel column in the pixel array, wherein the first switch is directly electrically coupled between the first pixel column and the data signal providing module;

a second switch, and the second switch is electrically coupled to the second select signal generation module, the data signal providing module and a second pixel column in the pixel array, wherein the second switch is directly electrically coupled between the second pixel column and the data signal providing module;

a third switch, and the third switch is electrically coupled to the first select signal generation module and the data signal providing module; and a fourth switch, and the fourth switch is electrically coupled to the second select signal generation module, the third switch and a third pixel column in the pixel array; the drive circuit further comprises a scan signal providing module, and the scan signal providing module is electrically coupled to the pixel array, and the scan signal providing module generates a scan signal, and sends the same to the pixel array, wherein the first select signal generation module controls the data signal to be inputted to the first pixel column in the pixel array, the second select signal generation module controls the data signal to be inputted to the second pixel column in the pixel array, and the first select signal generation module and the second select signal generation module control the data signal to be inputted to the third pixel column in the pixel array.

2. The drive circuit capable of reducing the voltage level changing frequency of the select signal according to claim 1, wherein the first switch comprises:

a first control end, and the first control end is electrically coupled to the first select signal generation module;

a first input end, and the first input end is electrically coupled to the data signal providing module; and a first output end, and the first output end is electrically coupled to the first pixel column;

wherein the first control end receives the first select signal, and controls on and off of a first current channel between the first input end and the first output end according to the first select signal;

the second switch comprises:

a second control end, and the second control end is electrically coupled to the second select signal generation module;

a second input end, and the second input end is electrically coupled to the data signal providing module; and a second output end, and the second output end is electrically coupled to the second pixel column;

wherein the second control end receives the second select signal, and controls on and off of a second current channel between the second input end and the second output end according to the second select signal;

the third switch comprises:

a third control end, and the third control end is electrically coupled to the first select signal generation module;

a third input end, and the third input end is electrically coupled to the data signal providing module; and a third output end, and the third output end is electrically coupled to the fourth switch;

wherein the third control end receives the first select signal, and controls on and off of a third current channel between the third input end and the third output end according to the first select signal;

the fourth switch comprises:

a fourth control end, and the fourth control end is electrically coupled to the second select signal generation module;

a fourth input end, and the fourth input end is electrically coupled to the third output end;

a fourth output end, and the fourth output end is electrically coupled to the third pixel column;

wherein the fourth control end receives the second select signal, and controls on and off of a fourth current channel between the fourth input end and the fourth output end according to the second select signal.

3. The drive circuit capable of reducing the voltage level changing frequency of the select signal according to claim 2, wherein the first current channel is off when the third current channel is on, and on when the third current channel is off;

the second current channel is off when the fourth current channel is on, and on when the fourth current channel is off;

the third current channel is off when the first current channel is on, and on when the first current channel is off;

the fourth current channel is off when the second current channel is on, and on when the second current channel is off.

4. The drive circuit capable of reducing the voltage level changing frequency of the select signal according to claim 1, wherein a high voltage level duration of the first select signal and a high voltage level duration of the second select signal are the same, and a low voltage level duration of the first select signal and a low voltage level duration of the second select signal are the same;

both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer;

a starting point of a rising edge of a high voltage level of a scan signal of the pixel array is in the high voltage level duration of the first select signal or the high voltage level duration of the second select signal.

5. A drive circuit capable of reducing a voltage level changing frequency of a select signal, wherein the drive circuit is employed to control a pixel array in a corresponding display panel to show images, and the drive circuit comprises:

a data signal providing module, generating a data signal, and the data signal is provided to the pixel array;

a first select signal generation module, providing a first select signal;

a second select signal generation module, providing a second select signal; and a select module, and the select module comprises:

at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal, the select switch combination comprises:

a first switch, and the first switch is electrically coupled to the first select signal generation module, the data signal providing module and a first pixel column in the pixel array, wherein the first switch is directly electrically coupled between the first pixel column and the data signal providing module;

a second switch, and the second switch is electrically coupled to the second select signal generation module, the data signal providing module and a second pixel column in the pixel array, wherein the second switch is directly electrically coupled between the second pixel column and the data signal providing module;

a third switch, and the third switch is electrically coupled to the first select signal generation module and the data signal providing module; and a fourth switch, and the fourth switch is electrically coupled to the second select signal generation module, the third switch and a third pixel column in the pixel array;

wherein the first select signal generation module controls the data signal to be inputted to a first pixel column in the pixel array, the second select signal generation module controls the data signal to be inputted to a second pixel column in the pixel array, and the first select signal generation module and the second select signal generation module control the data signal to be inputted to a third pixel column in the pixel array.

6. The drive circuit capable of reducing the voltage level changing frequency of the select signal according to claim 5, wherein the first switch comprises:

a first control end, and the first control end is electrically coupled to the first select signal generation module;

a first input end, and the first input end is electrically coupled to the data signal providing module; and a first output end, and the first output end is electrically coupled to the first pixel column;

wherein the first control end receives the first select signal, and controls on and off of a first current channel between the first input end and the first output end according to the first select signal;

the second switch comprises:

a second control end, and the second control end is electrically coupled to the second select signal generation module;

a second input end, and the second input end is electrically coupled to the data signal providing module; and a second output end, and the second output end is electrically coupled to the second pixel column;

wherein the second control end receives the second select signal, and controls on and off of a second current channel between the second input end and the second output end according to the second select signal;

the third switch comprises:

a third control end, and the third control end is electrically coupled to the first select signal generation module;

a third input end, and the third input end is electrically coupled to the data signal providing module; and a third output end, and the third output end is electrically coupled to the fourth switch;

wherein the third control end receives the first select signal, and controls on and off of a third current channel between the third input end and the third output end according to the first select signal;

the fourth switch comprises:

a fourth control end, and the fourth control end is electrically coupled to the second select signal generation module;

a fourth input end, and the fourth input end is electrically coupled to the third output end;

a fourth output end, and the fourth output end is electrically coupled to the third pixel column;

wherein the fourth control end receives the second select signal, and controls on and off of a fourth current channel between the fourth input end and the fourth output end according to the second select signal.

7. The drive circuit capable of reducing the voltage level changing frequency of the select signal according to claim 6, wherein the first control end is electrically coupled to the first select signal generation module via a first signal line;

the second control end, and the second control end is electrically coupled to the second select signal generation module via a second signal line;

the third control end is electrically coupled to the first select signal generation module via the first signal line;

the fourth control end is electrically coupled to the second select signal generation module via the second signal line.

8. The drive circuit capable of reducing the voltage level changing frequency of the select signal according to claim 6, wherein the first current channel is off when the third current channel is on, and on when the third current channel is off;

the second current channel is off when the fourth current channel is on, and on when the fourth current channel is off;

the third current channel is off when the first current channel is on, and on when the first current channel is off;

the fourth current channel is off when the second current channel is on, and on when the second current channel is off.

9. The drive circuit capable of reducing the voltage level changing frequency of the select signal according to claim 8, wherein both the first switch and the second switch are NMOS TFT, and both the third switch and the fourth switch are PMOS TFTs; or both the first switch and the second switch are PMOS TFTs, and both the third switch and the fourth switch are NMOS TFT.

10. The drive circuit capable of reducing the voltage level changing frequency of the select signal according to claim 5, wherein a high voltage level duration of the first select signal and a high voltage level duration of the second select signal are the same, and a low voltage level duration of the first select signal and a low voltage level duration of the second select signal are the same;

both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer;

a starting point of a rising edge of a high voltage level of a scan signal of the pixel array is in the high voltage level duration of the first select signal or the high voltage level duration of the second select signal.

11. The drive circuit capable of reducing the voltage level changing frequency of the select signal according to claim 10, wherein a high voltage level duration of the scan signal is 3K clock unit cycles, and a low voltage level duration of the scan signal is 3K clock unit cycles, too.

12. A display panel capable of reducing a voltage level changing frequency of a select signal, wherein the display panel comprises:

a pixel array; and a drive circuit, and the drive circuit is employed to control the pixel array to show images, and the drive circuit comprises:

a data signal providing module, generating a data signal, and the data signal is provided to the pixel array;

a first select signal generation module, providing a first select signal;

a second select signal generation module, providing a second select signal; and a select module, and the select module comprises:

at least two select switch combinations, and the select switch combination is electrically coupled to the first select signal generation module, the second select signal generation module, the data signal providing module and the pixel array, and the select switch combination receives the first select signal, the second select signal and the data signal, and outputs the data signal to the pixel array according to the first select signal and the second select signal, the select switch combination comprises:

a first switch, and the first switch is electrically coupled to the first select signal generation module, the data signal providing module and a first pixel column in the pixel array, wherein the first switch is directly electrically coupled between the first pixel column and the data signal providing module;

a second switch, and the second switch is electrically coupled to the second select signal generation module, the data signal providing module and a second pixel column in the pixel array, wherein the second switch is directly electrically coupled between the second pixel column and the data signal providing module;

a third switch, and the third switch is electrically coupled to the first select signal generation module and the data signal providing module; and a fourth switch, and the fourth switch is electrically coupled to the second select signal generation module, the third switch and a third pixel column in the pixel array: wherein the first select signal generation module controls the data signal to be inputted to a first pixel column in the pixel array, the second select signal generation module controls the data signal to be inputted to a second pixel column in the pixel array, and the first select signal generation module and the second select signal generation module control the data signal to be inputted to a third pixel column in the pixel array.

13. The display panel capable of reducing the voltage level changing frequency of the select signal according to claim 12, wherein the first switch comprises:

a first control end, and the first control end is electrically coupled to the first select signal generation module;

a first input end, and the first input end is electrically coupled to the data signal providing module; and a first output end, and the first output end is electrically coupled to the first pixel column;

wherein the first control end receives the first select signal, and controls on and off of a first current channel between the first input end and the first output end according to the first select signal;

the second switch comprises:

a second control end, and the second control end is electrically coupled to the second select signal generation module;

a second input end, and the second input end is electrically coupled to the data signal providing module; and a second output end, and the second output end is electrically coupled to the firet second pixel column;

wherein the second control end receives the second select signal, and controls on and off of a second current channel between the second input end and the second output end according to the second select signal;

the third switch comprises:

a third control end, and the third control end is electrically coupled to the first select signal generation module;

a third input end, and the third input end is electrically coupled to the data signal providing module; and a third output end, and the third output end is electrically coupled to the fourth switch;

wherein the third control end receives the first select signal, and controls on and off of a third current channel between the third input end and the third output end according to the first select signal;

the fourth switch comprises:

a fourth control end, and the fourth control end is electrically coupled to the second select signal generation module;

a fourth input end, and the fourth input end is electrically coupled to the third output end;

a fourth output end, and the fourth output end is electrically coupled to the third pixel column;

wherein the fourth control end receives the second select signal, and controls on and off of a fourth current channel between the fourth input end and the fourth output end according to the second select signal.

14. The display panel capable of reducing the voltage level changing frequency of the select signal according to claim 13, wherein the first control end is electrically coupled to the first select signal generation module via a first signal line;

the second control end, and the second control end is electrically coupled to the second select signal generation module via a second signal line;

the third control end is electrically coupled to the first select signal generation module via the first signal line;

the fourth control end is electrically coupled to the second select signal generation module via the second signal line.

15. The display panel capable of reducing the voltage level changing frequency of the select signal according to claim 13, wherein the first current channel is off when the third current channel is on, and on when the third current channel is off;

the second current channel is off when the fourth current channel is on, and on when the fourth current channel is off;

the third current channel is off when the first current channel is on, and on when the first current channel is off;

the fourth current channel is off when the second current channel is on, and on when the second current channel is off.

16. The display panel capable of reducing the voltage level changing frequency of the select signal according to claim 15, wherein both the first switch and the second switch are NMOS TFT, and both the third switch and the fourth switch are PMOS TFTs; or both the first switch and the second switch are PMOS TFTs, and both the third switch and the fourth switch are NMOS TFT.

17. The display panel capable of reducing the voltage level changing frequency of the select signal according to claim 12, wherein a high voltage level duration of the first select signal and a high voltage level duration of the second select signal are the same, and a low voltage level duration of the first select signal and a low voltage level duration of the second select signal are the same;

both a high voltage level duration of the first select signal and a high voltage level duration of the second select signal are 2K clock unit cycles, and both a low voltage level duration of the first select signal and a low voltage level duration of the second select signal are 4K clock unit cycles, wherein the K is a positive integer;

a starting point of a rising edge of a high voltage level of a scan signal of the pixel array is in the high voltage level duration of the first select signal or the high voltage level duration of the second select signal.

18. The drive circuit capable of reducing the voltage level changing frequency of the select signal according to claim 17, wherein a high voltage level duration of the scan signal is 3K clock unit cycles, and a low voltage level duration of the scan signal is 3K dock unit cycles, too.

* * * * *